US011441566B2

(12) United States Patent
Lee et al.

(10) Patent No.: US 11,441,566 B2
(45) Date of Patent: Sep. 13, 2022

(54) ROTARY COMPRESSOR HAVING ROLLER WITH DIMPLE PORTION

(71) Applicant: LG ELECTRONICS INC., Seoul (KR)

(72) Inventors: Jingyu Lee, Seoul (KR); Sangmin Na, Seoul (KR); Wonbae Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 135 days.

(21) Appl. No.: 16/838,261

(22) Filed: Apr. 2, 2020

(65) Prior Publication Data

US 2020/0378386 A1 Dec. 3, 2020

(30) Foreign Application Priority Data

May 31, 2019 (KR) ..... 10-2019-0064682

(51) Int. Cl.
*F03C 2/00* (2006.01)
*F03C 4/00* (2006.01)
(Continued)

(52) U.S. Cl.
CPC ..... *F04C 29/028* (2013.01); *F01C 21/0809* (2013.01); *F04C 18/324* (2013.01);
(Continued)

(58) Field of Classification Search
CPC .... F04C 18/324; F04C 18/344; F04C 18/356; F04C 18/3564; F04C 23/008;
(Continued)

(56) References Cited

U.S. PATENT DOCUMENTS 3,250,260 A * 5/1966 Heydrich ..... F01C 1/3446 418/265
5,265,457 A * 11/1993 Hayashi ..... F01C 21/08 418/178
(Continued)

FOREIGN PATENT DOCUMENTS

CH 206798 8/1939
JP H07-174088 7/1995
(Continued)

OTHER PUBLICATIONS

Korean Office Action dated Jul. 17, 2020 issued in KR Application No. 10-2019-0064682.
European Search Report dated Aug. 6, 2020 issued in EP Application No. 20171956.4.

*Primary Examiner* — Theresa Trieu
(74) *Attorney, Agent, or Firm* — KED & Associates LLP

(57) ABSTRACT

A rotary compressor may include a rotary shaft; a plurality of plates that supports the rotary shaft; a cylinder provided between the plurality of plates to define a compression space, and provided with a vane slot; a roller slidably coupled to the rotary shaft inside of the cylinder, and having a hinge groove on an outer circumferential surface thereof; and a vane, a first end of which is slidably coupled to the vane slot of the cylinder, and a second end of which is rotatably coupled to the hinge groove of the roller. At least one of first and second axial end surfaces of the roller facing the plurality of plates is provided with a dimple portion having a predetermined depth. With this structure, contact surfaces between the roller and the plate may be prevented from being in close contact with each other.

17 Claims, 12 Drawing Sheets

(51) Int. Cl.

| | |
|---|---|
| ***F04C 2/00*** | (2006.01) |
| ***F04C 29/02*** | (2006.01) |
| ***F01C 21/08*** | (2006.01) |
| ***F04C 18/324*** | (2006.01) |
| ***F04C 18/356*** | (2006.01) |
| *F04C 23/00* | (2006.01) |

(52) U.S. Cl.
CPC ..... *F04C 18/356* (2013.01); *F04C 23/008* (2013.01); *F04C 2210/26* (2013.01)

(58) Field of Classification Search
CPC ..... F04C 29/028; F04C 2210/26; F04C 2210/268; F04C 2270/16; F01C 21/0809; F01C 21/0854; F01C 21/108
See application file for complete search history.

(56) References Cited

U.S. PATENT DOCUMENTS

| | | | | |
|---|---|---|---|---|
| 2011/0058970 | A1* | 3/2011 | Hugenroth | F04C 23/001 418/13 |
| 2017/0275996 | A1* | 9/2017 | Cho | F04C 18/356 |
| 2020/0370549 | A1* | 11/2020 | Lee | F04C 18/324 |

FOREIGN PATENT DOCUMENTS

| | | | | |
|---|---|---|---|---|
| JP | H11-294353 | | 10/1999 | |
| JP | 2001-221179 | | 8/2001 | |
| JP | 2001221179 | A * | 8/2001 | F04C 18/3441 |
| JP | 2010-168977 | | 8/2010 | |
| KR | 10-2016-0034071 | | 3/2016 | |
| WO | WO 2010/087180 | | 8/2010 | |

* cited by examiner

ROTARY COMPRESSOR HAVING ROLLER WITH DIMPLE PORTION

CROSS-REFERENCE TO RELATED APPLICATION(S)

Pursuant to 35 U.S.C. § 119(a), this application claims the benefit of an earlier filing date of and the right of priority to Korean Patent Application No. 10-2019-0064682, filed in Korea on May 31, 2019, the contents of which are incorporated by reference herein in its entirety.

BACKGROUND

1. Field

A rotary compressor, and more particularly, a rotary compressor in which a roller and a vane are coupled to each other are disclosed herein.

2. Background

A rotary compressor compresses refrigerant using a roller performing an orbiting movement in a compression space of a cylinder and a vane in contact with an outer circumferential surface of the roller to partition the compression space of the cylinder into a plurality of spaces. The rotary compressor may be divided into a rolling piston type and a hinge vane type according to whether the roller and the vane are coupled to each other. The rolling piston type is a type in which the vane is detachably coupled to the roller so that the vane is closely attached to the roller, and the hinge vane type is a type in which the vane is hinge-coupled to the roller. KR1020160034071A (hereinafter "Patent Document 1") and JP2010-168977A (hereinafter "Patent Document 2" each discloses a hinge vane type, the hinge vane type having a stable vane behavior compared to the rolling piston type, thereby reducing axial leakage.

However, in the rotary compressor, a compression reaction force is generated in the compression space during the compression process, and the roller receives a force in an axial direction by this compression reaction force. At this time, there exists a gap due to tolerance between the roller and the vane, and plates located at both sides of the roller. This gap causes a tilting phenomenon in which the roller is inclined to one side with respect to an axial center during operation, and the roller and the plate collide with or press against each other. In particular, severe wear may occur in a portion of the roller located at the discharge side with respect to the vane as a thermal deformation amount greatly increases compared to the other portion.

In a rolling piston type rotary compressor, as the roller is not constrained to the vane, when the roller is tilted and collides with the plate during operation, the compressor may be quickly restored to a posture capable of avoiding collision. Because of this, the rolling piston type may prevent wear that may occur between the roller and the plate in advance.

In contrast, in a hinge vane type rotary compressor, as the roller is constrained to the vane, even when the roller is tilted and collides with the plate, the compressor continues to rotate with respect to the plate in a collided or pressed state without being quickly restored to a posture capable of avoiding collision. For this reason, in the hinge vane type, wear between the roller and the plate may severely occur. In particular, in the hinge vane type, as a position of the roller is almost fixed by the vane, a thermal deformation amount at a portion of the roller located on the discharge side increases. As a result, in the hinge vane type, wear between the roller and the plate may be further increased, thereby reducing compressor efficiency. Wear between the roller and the plate is not taken into consideration in the roller disclosed in Patent Document 1 and Patent Document 2, and a communication path disclosed in Patent Document 2 is provided at one end surface of the roller to merely secure a discharge path, and such a problem may still occur in Patent Document 1, as well as Patent Document 2.

BRIEF DESCRIPTION OF THE DRAWINGS

Embodiments will be described in detail with reference to the following drawings in which like reference numerals refer to like elements wherein.

DETAILED DESCRIPTION

Hereinafter, a rotary compressor according to embodiments will be described with reference to the accompanying drawings. The rotary compressor according to embodiments may be classified into a single rotary compressor or a double rotary compressor according to a number of cylinders. The embodiments relates to an axial side shape of a roller or a plate facing the roller in a hinge vane type rotary compressor in which the roller and a vane are coupled to each other. Therefore, the embodiments may be applied to both a single rotary compressor or a double rotary compressor. Hereinafter, a single rotary compressor will be described as an example, but the same description may also be applicable to a double rotary compressor.

Figure 1:
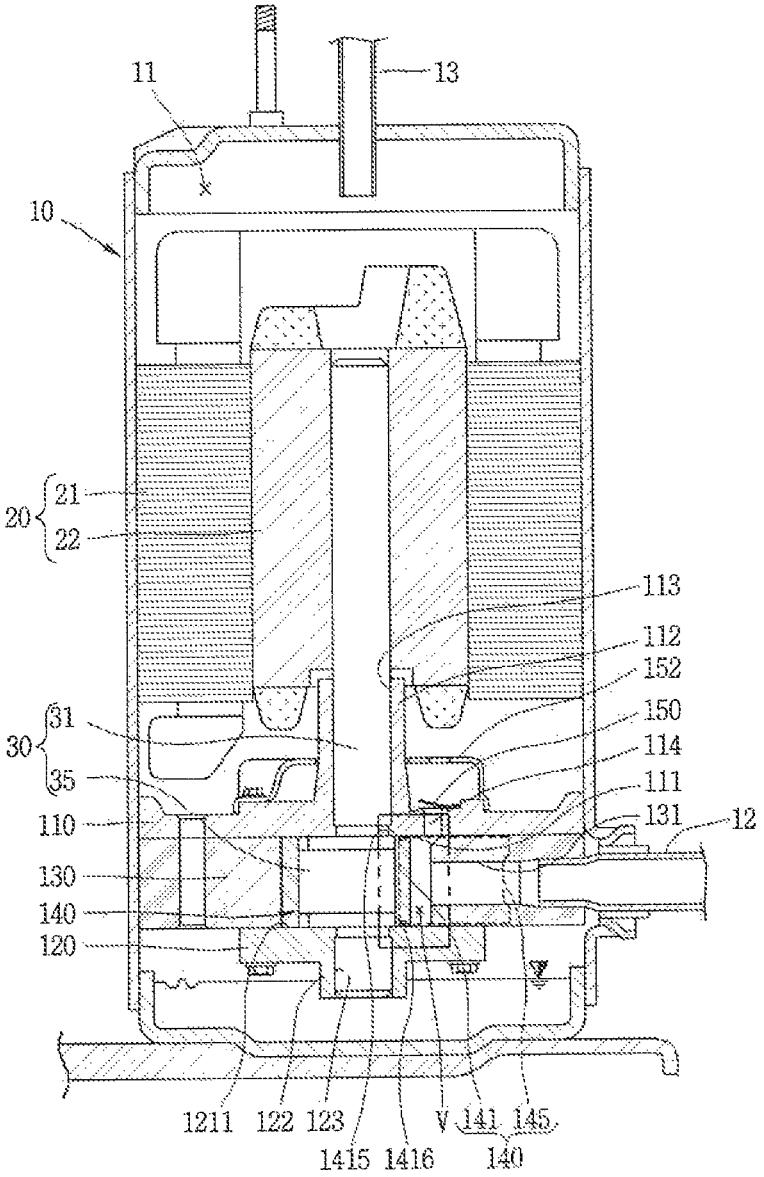
FIG. 1 is a longitudinal cross-sectional view showing a rotary compressor according to an embodiment.
Figure 2:
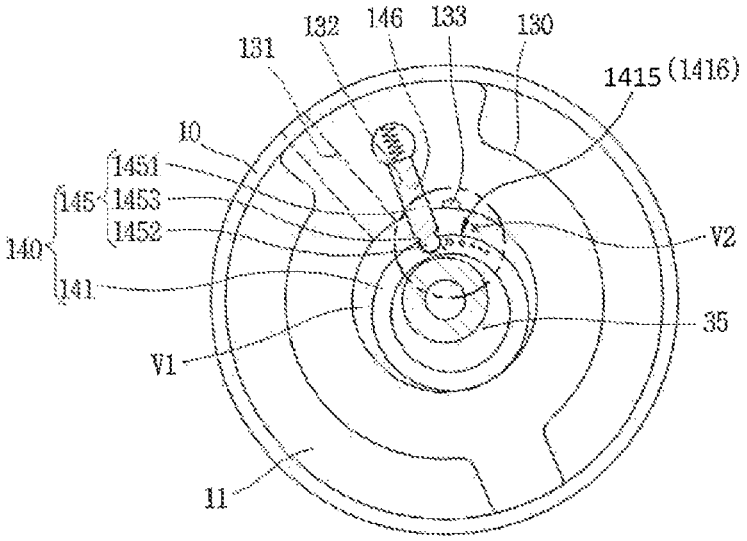
FIG. 2 is a transverse cross-sectional view showing a compression unit in the rotary compressor according to FIG. 1.
Figure 3:
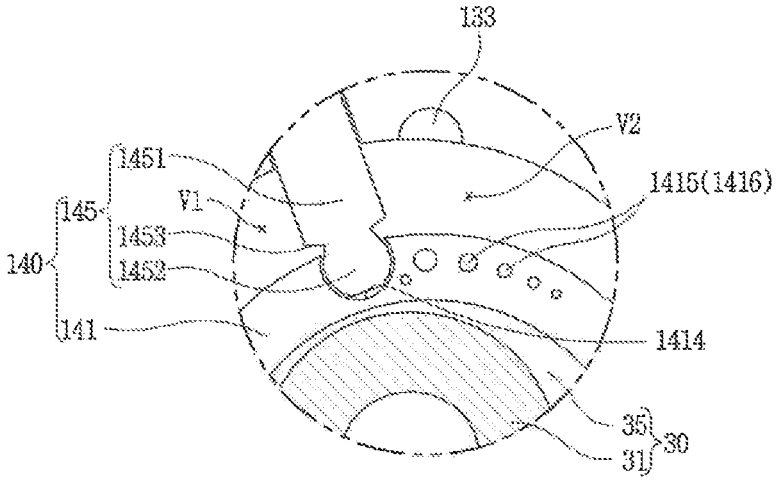
FIG. 3 is an enlarged transverse cross-sectional view showing a coupling portion between a roller and a vane in a vane roller according to FIG. 2.

FIG. 1 is a longitudinal cross-sectional view showing a rotary compressor according to an embodiment. FIG. 2 is a transverse cross-sectional view showing a compression unit in the rotary compressor according to FIG. 1. FIG. 3 is an enlarged transverse cross-sectional view showing a coupling portion between a roller and a vane in a vane roller according to FIG. 2.

Referring to FIGS. 1 and 2, in the rotary compressor according to an embodiment, an electric motor unit or electric motor 20 may be provided in an inner space 11 of a casing 10, and a compression unit 100 mechanically connected by a rotary shaft 30 may be provided in the inner space 11 of the casing 10 at a lower side of the electric motor unit 20.

The electric motor unit 20 may include a stator 21, for example, press-fitted and fixed to an inner circumferential surface of the casing 10 and a rotor 22 rotatably inserted into the stator 21. The rotary shaft 30 may be press-fitted and coupled to the rotor 22. An eccentric portion 35 is disposed eccentrically with respect to a shaft portion 31 in the rotary shaft 30, and a roller 141 of a vane roller 140, which will be described hereinafter, may be slidably coupled to the eccentric portion 35.

The compression unit 100 may include a main plate 110, a sub plate 120, a cylinder 130, and a vane roller 140. The main plate 110 and the sub plate 120 may be provided at both axial sides with the cylinder 130 interposed therebetween to define a compression space (V) inside of the cylinder 130. In addition, the main plate 110 and the sub plate 120 support the rotary shaft 30 passing through the cylinder 130 in a radial direction. The vane roller 140 may be coupled to the eccentric portion 35 of the rotary shaft 30 to compress refrigerant while performing an orbiting movement in the cylinder 130.

The main plate 110 may be defined in a disk shape, and side wall portion or side wall 111 may be, for example, shrink-fitted or welded to an inner circumferential surface of the casing 10 at an edge thereof. A main shaft receiving portion 112 may be disposed at a center of the main plate 110 to protrude upward, and a main shaft receiving hole 113 may be disposed at the main shaft receiving portion 112 to pass therethrough such that the rotary shaft 30 is inserted and supported thereto.

A discharge port 114 in communication with the compression space (V) to discharge refrigerant compressed in the compression space (V) to the inner space 11 of the casing 10 may be disposed at one side of the main shaft receiving portion 112. In some cases, the discharge port may be disposed in the sub plate 120 instead of the main plate 110.

The sub plate 120 may be defined in a disc shape and bolt-fastened, for example, to the main plate 110 together with the cylinder 130. Of course, when the cylinder 130 is fixed to the casing 10, the main plate 110 may be bolt-fastened, for example, to the cylinder 130 and the sub plate 120, respectively, and when the sub plate 120 fixed to the casing 10, the cylinder 130 and the main plate 110 may be bolt-fastened to the sub plate 120.

A sub shaft receiving portion 122 may be disposed at a center of the sub plate 120 to protrude downward, and a sub shaft receiving hole 123 may be disposed at the sub shaft receiving portion 122 to pass therethrough on a same axial line as the main shaft receiving hole 113. A lower end of the rotary shaft 30 may be supported by the sub shaft receiving hole 123.

The cylinder 130 may be formed in a circular annular shape with a same inner diameter on an inner circumferential surface thereof. An inner diameter of the cylinder 130 may be larger than an outer diameter of the roller 141 to define the compression space (V) between an inner circumferential surface of the cylinder 130 and an outer circumferential surface of the roller 141. Accordingly, the inner circumferential surface of the cylinder 130, the outer circumferential surface of the roller 141, and the vane 145 may define an outer wall surface of the compression space (V), an inner wall surface of the compression space (V), and a side wall surface of the compression space (V), respectively. Therefore, as the roller 141 performs an orbiting movement, the outer wall surface of the compression space (V) may define a fixed wall while the inner wall surface and the side wall surface of the compression space (V) define a variable wall whose position is variable.

A suction port 131 may be disposed in the cylinder 130, a vane slot 132 may be disposed at one circumferential side of the suction port 131, and a discharge guide groove 133 may be disposed at an opposite side of the suction port 131 with the vane slot 132 interposed therebetween. The suction port 131 may pass therethrough in a radial direction, and be connected to a suction pipe 12 passing through the casing 10. Accordingly, refrigerant may be suctioned into the compression space (V) of the cylinder 130 through the suction pipe 12 and the suction port 131.

The vane slot 132 may be defined in an elongated manner on an inner circumferential surface of the cylinder 130 in a direction toward an outer circumferential surface thereof. An inner circumferential side of the vane slot 132 is open, and an outer circumferential side thereof is closed. The vane slot 132 may have a width approximately equal to a thickness or width of the vane 145 to allow the vane 145 of the vane roller 140, which will be hereinafter, to slide therein. Accordingly, both side surfaces of the vane 145 are supported by both inner wall surfaces of the vane slot 132 to slide approximately linearly.

The discharge guide groove 133 may be defined in a chamfered shape at an inner edge of the cylinder 130. The discharge guide groove 133 may serve to guide refrigerant compressed in the compression space of the cylinder to the discharge port 114 of the main plate 110. However, as the discharge guide groove 133 generates a dead volume, the discharge guide groove should not be provided unless necessary, and if the discharge guide groove is provided, a volume thereof should be kept to a minimum.

Referring to FIG. 3, the vane roller 140 may include a roller 141 and a vane 145 as described above. The roller 141 and the vane may be a single body or may be coupled to each other to allow relative movement. The embodiment will be described based on an example in which the roller and the vane are rotatably coupled to each other.

The roller 141 may be rotatably inserted into and coupled to eccentric portion 35 of the rotary shaft 30, and the vane 145 may be slidably coupled to the vane slot 132 of the cylinder 130 and hinge-coupled to an outer circumferential surface of the roller 141. Accordingly, the roller 141 may perform an orbiting movement inside of the cylinder 130 by the eccentric portion 35 during rotation of the rotary shaft 30, and the vane may reciprocate in a state of being coupled to the roller 141.

The roller 141 may be defined in a cylindrical shape having a predetermined diameter and thickness. For example, the roller 141 may be defined in an annular shape to have an inner diameter such that an inner circumferential surface thereof may be in sliding contact with an outer circumferential surface of the eccentric portion 35 of the rotary shaft 30. A thickness of the roller 141 may have a thickness sufficient to secure a sealing distance to a hinge groove 1414, which will be described hereinafter.

Hinge groove 1414 may be disposed on the outer circumferential surface of the roller body 1411 so that a hinge protrusion 1452 of the vane 145, which will be described hereinafter, may be inserted to rotate. The hinge groove 1414 will be described hereinafter.

The vane 145 may include a vane body 1451, hinge protrusion 1452, and an interference avoiding surface 1453. The vane body 1451 may be defined in a flat plate shape having a predetermined length and thickness. For example, the vane body 1451 may be defined in a rectangular hexagonal shape as a whole. In addition, the vane body 1451 may be defined by a length such that the vane 145 remains in the vane slot 132 even when the roller 141 is completely moved to an opposite side of the vane slot 132.

The hinge protrusion 1452 may extend to a front end portion of the vane body 1451 facing the roller 141. The hinge protrusion 1452 may be inserted into the hinge groove 1414 and have a rotatable cross-sectional area. The hinge protrusion 1452 may be defined in a substantially circular cross-sectional shape except for a semicircular or connecting portion to correspond to the hinge groove 1414.

The interference avoiding surface 1453 is a portion disposed to prevent the vane body 1451 from interfering with an axial edge of the hinge groove 1414 when the vane 145 rotates with respect to the roller 141. Accordingly, the interference avoiding surface 1453 may be disposed in a direction in which an area between the vane body 1451 and the hinge protrusion 1452 decreases. The interference avoiding surface 1453 may be defined in a wedge cross-sectional shape or in a curved cross-sectional shape, for example.

Reference numerals 150 and 152 on the drawing denote a discharge valve and a muffler, respectively, and 13 denotes a discharge pipe.

The foregoing rotary compressor according to an embodiment operates as follows.

When power is applied to the electric motor unit 20, the rotor 22 of the electric motor unit 20 is rotated to rotate the rotary shaft 30. Then, the roller 141 of the vane roller 140 coupled to the eccentric portion 35 of the rotary shaft 30 rotates to suction refrigerant into the compression space (V) of the cylinder 130. The refrigerant repeats a series of processes of being compressed by the roller 141 and the vane 145 of the vane roller 140 and discharged into the inner space 11 of the casing 10 through the discharge port 114 provided in the main plate 110.

At this time, in a rolling piston type, a gap between the roller 141 and the vane 145 is increased by a vane jumping phenomenon generated during operation, and refrigerant leakage between compression chambers may be generated through the increased gap. In contrast, in a hinge vane type as according to an embodiment, the vane jumping phenomenon may be suppressed to reduce refrigerant leakage in the compression space.

However, as described above, in the rotary compressor, due to its characteristics, the roller 141 is tilted about its axial center by a compression reaction force such that both axial cross-sections of the roller 141 collide with or press against an axial side surfaces of the main plate 110 and an axial side surface of sub plate 120. Further, the roller 141 is thermally deformed as a temperature of the compression space rises, and the thermally deformed roller 141 is tilted in an axial direction by the compression reaction force to further strongly collide with or press against the main plate 110 or the sub plate 120.

In particular, in a hinge vane type in which the vane 145 is coupled to the roller 141 as in the embodiment, the roller 141 is constrained by the vane 145 such that a specific portion on an axial cross section of the roller 141 continues to perform an orbiting movement while being pressed against an axial side surface of the main plate 110 or the sub plate 120. Then, an axial top or bottom edge of the roller 141 scratches an axial side surface of the main plate 110 or sub plate 120 defining a compression space, wearing out the axial top or bottom edge of the roller or an axial side surface of the main plate 110 or an axial side surface of the sub plate 120. The worn-out portion is opened, generating refrigerant leakage in the compression space during operation of the compressor and reducing compression efficiency or foreign substances may be generated during the process of scratching the plate by the roller, causing wear on a different bearing surface or contact surface.

Thus, in the embodiment, dimple portions or lubrication portions may be disposed on both axial end surfaces of the roller or both axial side surfaces of the main plate and the sub plate facing the axial end surfaces of the roller. Hereinafter, this structure will be referred to as a "dimple portion" as a unified term.

Figure 4:
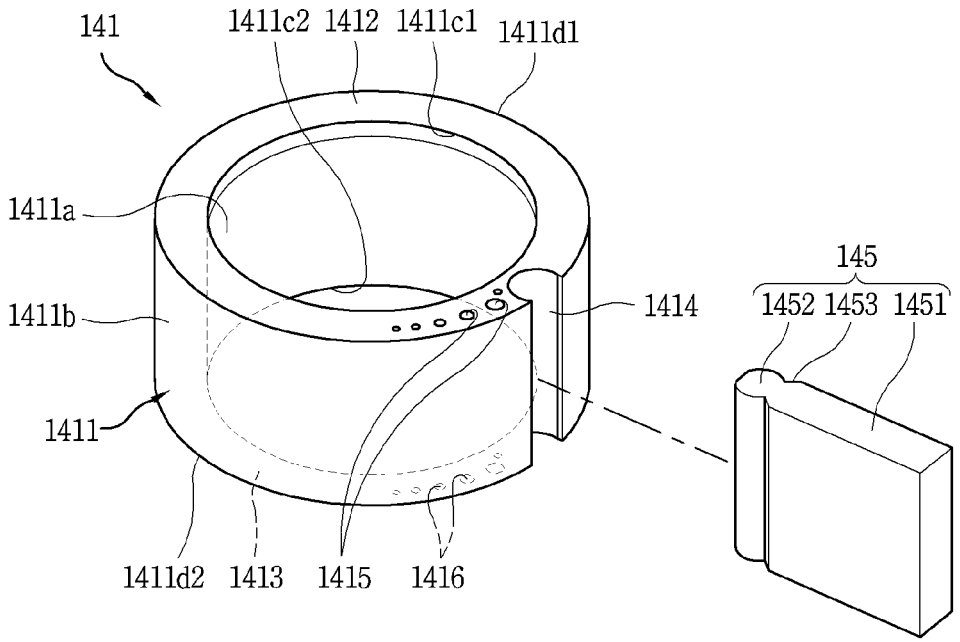
FIG. 4 is an exploded perspective view showing a roller and a vane in a vane roller according to an embodiment.
Figure 5:
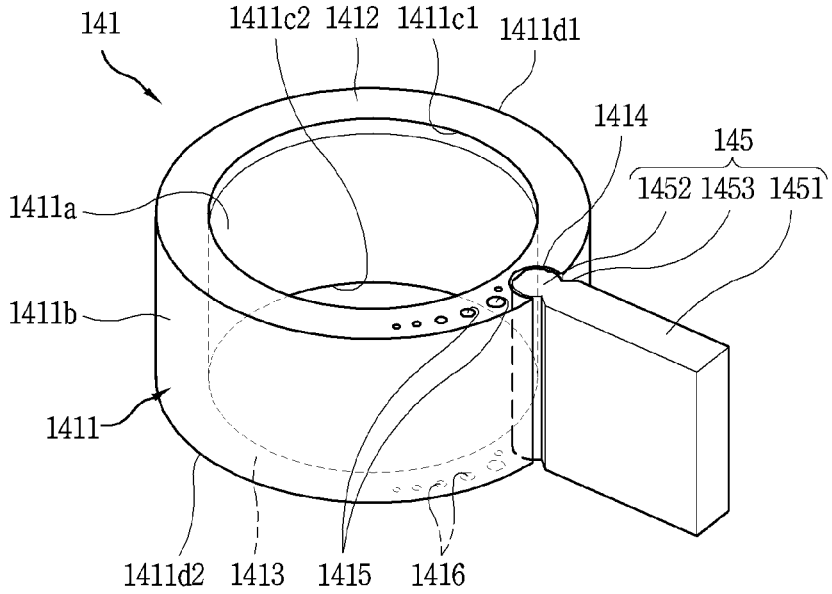
FIG. 5 is an assembled perspective view showing the roller and the vane in the vane roller of FIG. 4.

FIG. 4 is an exploded perspective view showing a roller and a vane in a vane roller according to an embodiment. FIG. 5 is an assembled perspective view showing the roller and the vane in the vane roller of FIG. 4.

Referring to FIG. 4, the vane roller 140 according to the embodiment may include a roller 141, and a vane 145 hinge-coupled to the roller 141, as described above. The roller 141 may include a roller body 1411, a sealing surface 1412, 1413, a hinge groove 1414, and a dimple portion 1415, 1416.

The roller body 1411 may be defined in a cylindrical shape. An axial height of the roller body 1411 may be approximately equal to an inner circumferential height of the cylinder 130. However, as the roller 141 must slide relative to the main plate 110 and the sub plate 120, the axial height of the roller body 1411 may be slightly smaller than the inner circumferential height of the cylinder 130.

Further, the inner circumferential height and the outer circumferential height of the roller body 1411 may be substantially the same. Accordingly, axial cross-sections connecting the inner circumferential surface and the outer circumferential surface of the roller body 1411 may define the sealing surfaces 1412, 1413 described above, and the sealing surfaces 1412, 1413 may be perpendicular to the inner or outer circumferential surface of the roller body 1411.

The sealing surfaces 1412, 1413 are surfaces facing an axial side surface of the main plate 110 or an axial side surface of the sub plate 120, and may be disposed in parallel to each axial side surface. Hereinafter, description will be given by defining the axial side surface of the main plate 110 as a first thrust surface 1111, and the axial side surface of the sub plate 120 as a second thrust surface 1211, and defining a surface facing the first thrust surface 1111 a first sealing surface 1412 and a surface facing the second thrust surface 1211 a second sealing surface 1413 between the sealing surfaces 1412, 1413. Radial lengths of the first sealing surface 1412 and the second sealing surface 1413 may be defined to ensure a sealing length capable of suppressing refrigerant in compression chamber (V) from being leaked toward the inner circumferential surface of the roller body 1411.

In addition, an inner edge **1411*c*1, 1411*c*2 connecting inner circumferential surface 1411*a* of the roller body 1411 and the sealing surface 1412, 1413 or an outer edge 1411*d*1, 1411*d*2 connecting outer circumferential surface 1411*b* of the roller body 1411 and the sealing surface 1412, 1413** may be at a right angle, or may be slightly inclined or curved. Hereinafter, a case where the edge is at a right angle will be described as an example, but the description may also be similarly applicable to a case where the edge is an inclined or curved surface.

The hinge groove 1414 may be axially elongated so as to connect the first sealing surface 1412 and the second sealing surface 1413 of the roller body 1411. The hinge groove 1414 may be defined in an arc shape in a planar projection. For example, the hinge groove 1414 may be defined in a semi-circular cross-sectional shape, but is defined to have a larger arc length than the semi-circle to prevent hinge protrusion 1452 from being released.

As shown in FIG. 5, the dimple portion 1415, 1416 is disposed on at least one of the first sealing surface 1412 and the second sealing surface 1413. More precisely, the dimple portion 1415, 1416 is disposed to have a predetermined depth at an outer edge thereof.

The dimple portion 1415, 1416 according to the embodiment will be described with an example in which dimple portions are disposed on both sealing surfaces located at both axial sides thereof. In addition, when it is required to distinguish a dimple portion disposed on the first sealing surface from a dimple portion disposed on the second sealing surface below, description will be given by defining a dimple portion disposed at an outer edge 1411*d*1 including the first sealing surface 1412 as a first dimple portion 1415, and a dimple portion disposed at an outer edge 1411*d*2 including the second sealing surface 1413 as a second dimple portion 1416. However, when it is not required to distinguish the first dimple portion from the second dimple portion, it will be collectively referred to as a dimple portion.

The dimple portion 1415, 1416 may prevent the first sealing surface 1412 and the second sealing surface 1413 of the roller 141 from colliding with or pressing against the first thrust surface 1111 of the main plate 110 or the second thrust surface 1211 of the sub plate 120 when the roller 141 is inclined or inclined with respect to a shaft center during operation of the compressor. In the rotary compressor according to the embodiment, a discharge pressure is defined at a portion defining a discharge chamber (V2) based on the vanes 145. The roller 141 is subject to a greatest compression reaction force at a portion belonging to a range of the discharge chamber (V2) and tilted to a greatest extent.

In particular, when the roller 141 is constrained to the vane 145 not to rotate as in the embodiment, a specific portion of the roller 141, that is, a circumference of the hinge groove 1414 coupled to the vane 145, is tilted to the greatest extent to collide with or press against the main plate 110 or the sub plate 120. Therefore, the dimple portion 1415, 1416 may be disposed at a portion defining discharge chamber (V) or at a position closest to the portion defining the discharge chamber (V) on the sealing surface of the roller 141. Based on the hinge groove 1414 to which the vane 145 is coupled, the vane 145 may include the hinge groove 1414 or be disposed around the hinge groove 1414.

Figure 6:
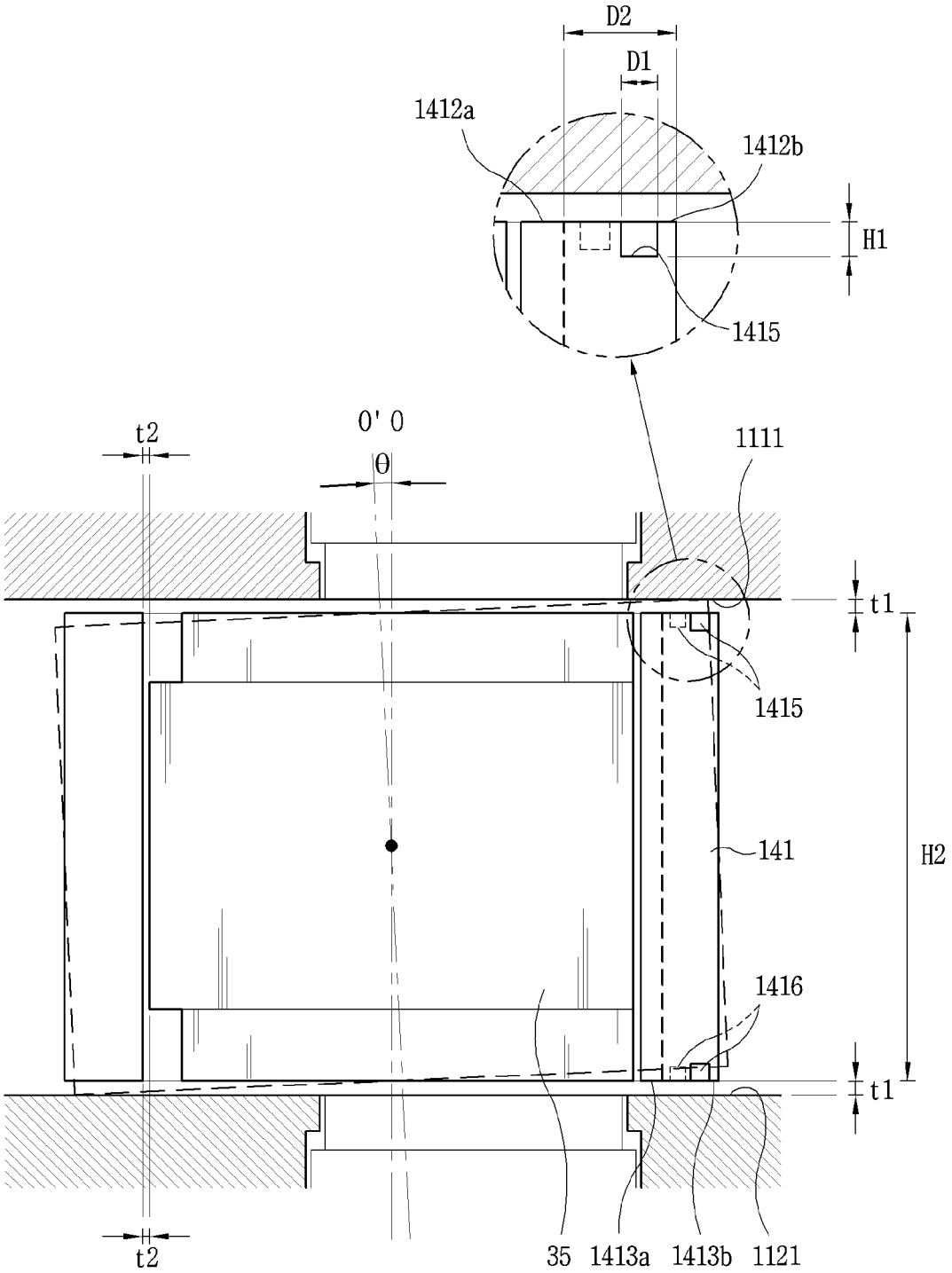
FIG. 6 is a schematic view for explaining a dimple portion according to an embodiment.

On the other hand, the position of the dimple portion according to the embodiment may be defined in consideration of a tilting amount and thermal deformation amount of the roller. FIG. 6 is a schematic view for explaining a specification of a dimple portion according to an embodiment. For reference, a gap between members illustrated in FIG. 6 is exaggerated.

Referring to FIG. 6, the dimple portion 1415, 1416 may be disposed at the outer edge 1411*d*1, 1411*d*2 of the roller body 1411 in consideration of the tilting amount of the roller 141. For example, when a distance between the sealing surfaces 1412, 1413 of the roller 141 and the first thrust surface 1111 of the main plate 110 facing the roller 141 or the second thrust surface 1211 of the sub plate 120 is referred to as a first gap (t1), and a distance between the inner circumferential surface 1411*a* of the roller body 1411 and an outer circumferential surface 35*a* of the eccentric portion 35 of the rotary shaft 30 facing this is referred to as a second gap (t2), the roller is tilted with respect to shaft center (O) by a predetermined angle (θ) during operation of the compressor due to the first and second gaps.

Then, as described above, when the roller 141 is tilted, the outer edge 1411*d*1, 1411*d*2 firstly collides with or presses against the first thrust surface 1111 of the main plate 110 or the second thrust surface of the sub plate 120. Accordingly, the dimple portion 1415, 1416 may be disposed at the outer edge 1411*d*1, 1411*d*2 rather than the inner edge 1411*c*1, 1411*c*2 of the roller 141 or disposed to include at least the outer edge 1411*d*1, 1411*d*2. This is the same even when taking the thermal deformation amount, which will be described, into consideration.

The dimple portion 1415, 1416 may be disposed in consideration of thermal deformation. In other words, the first gap (t1) described above may be primarily defined by the second gap (t2). However, the first gap (t1) is not always constant along a circumferential direction of the roller 141. In particular, during operation of the compressor, thermal deformation is generated by compression heat, and the thermal deformation may be differently defined according to a circumferential position of the roller 141.

For example, the roller 141 may have a larger amount of thermal deformation at a portion defining the discharge chamber (V2) than at a portion defining suction chamber (V1). Therefore, the first gap (t1) may be narrowest at a portion where the discharge chamber (V2) is located, based on the circumferential direction of the roller 141. The narrowest first gap (t1) denotes that the roller is most likely to press against the plate at that portion, and thus, the dimple portion 1415, 1416 may be disposed at a portion where thermal deformation occurs at a largest scale.

As a result, the dimple portion 1415, 1416 may be disposed at a portion having a largest compression reaction force and a portion having a largest thermal deformation amount based on the circumferential direction of the roller 141. This portion of the roller 141 belongs to a range that defines the discharge chamber (V2) as described above. Accordingly, with respect to the hinge groove 1414, the dimple portion 1415, 1416 according to the embodiment may be disposed at a side at which the discharge port 114 of the main plate 110 is provided between both circumferential directions of the hinge groove 1414.

Figure 7:
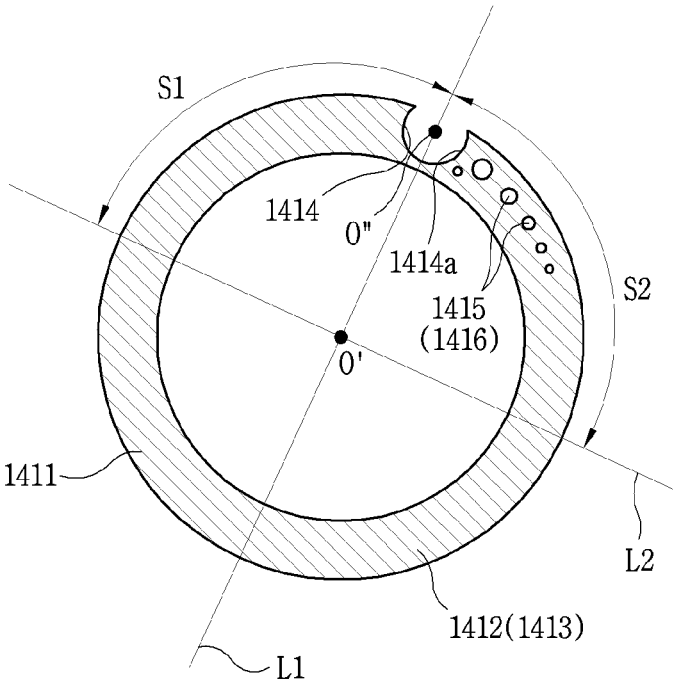
FIG. 7 is a schematic view showing a roller at an upper axial side thereof to explain a position of the dimple portion according to an embodiment.

FIG. 7 is a schematic view showing a roller at an upper axial side thereof to explain a position of the dimple portion according to an embodiment. Referring to FIG. 7, a line passing through center (O') of the roller 141 and center (O") of the hinge groove 1414 may be referred to as a first imaginary line (L1), and the center, and a line orthogonal to the first imaginary line (L1) may be referred to as a second imaginary line (L2), and the sealing surfaces 1412, 1413 of the roller 141 may be divided into four quadrants by the first imaginary line (L1) and the second imaginary line (L2) in planar projection. The dimple portion 1415, 1416 may be disposed in a range of quadrants adjacent to the hinge groove 1414 (hereinafter, the quadrants are defined as a first quadrant and a second quadrant).

Accordingly, on the sealing surface 1412, 1413 of the roller 141 according to the embodiment, when a portion belonging to the first quadrant adjacent to the hinge groove 1414 is referred to as a first portion (S1) based on the hinge groove 1414, and a portion belonging to the second quadrant adjacent to the hinge groove 1414 is referred to as a second portion (S2), and the first portion (S1) defines the suction chamber (V1) and the second portion (S2) defines the discharge chamber (V2) in the compression space (V), the dimple portion 1415, 1416 is disposed at the second portion (S2). The second portion (S2) constituting the discharge chamber (V2) defines a space having a higher pressure than the first portion (S1) constituting the suction chamber (V1). Accordingly, as the second portion (S2) is more thermally deformed than the first portion (S1), the dimple portion 1415, 1416 may be disposed at the second portion (S2) rather than the first portion (S1).

Further, the dimple portion 1415, 1416 according to the embodiment may be disposed as close as possible to a shortest distance from the hinge groove 1414 or disposed to communicate with the hinge groove 1414. As described above, the compression space may be divided into a plurality of spaces, that is, the suction chamber (V1) and the discharge chamber (V2) by the vane 145, and the amount of tilting and thermal deformation at a point closest to the vane 145 is the largest. Therefore, it is advantageous that the dimple portion 1415, 1416 is disposed to extend up to the inner circumferential surface 1414*a* of the hinge groove 1414 for reducing wear due to tilting and thermal deformation of the roller 141.

Referring again to FIGS. 5 and 6, a first height (H1), which is an axial height in the dimple portion 1415, 1416, may be lower than a second height (H2), which is an axial height at a portion outside of the dimple portion 1415, 1416, and the hinge protrusion 1452 of the vane 145 may have a same height as the second height (H2) of the roller 141 inserted into the hinge groove 1414. Therefore, even when the dimple portion 1415, 1416 extends to the hinge groove 1414 to reduce the height of the roller body 1411 at the hinge groove 1414, a space defining the discharge chamber (V2) and a space defining the suction chamber (V1) may be blocked by the hinge protrusion 1452 to suppress refrigerant leakage between the compression chambers.

However, a radial width (D1) of the dimple portion 1415, 1416 may be smaller than or equal to a radial depth (D2) of the hinge groove 1414. If the radial depth (D1) of the dimple portion 1415, 1416 is greater (deeper) than the radial depth (D2) of the hinge groove 1414, the dimple portion 1415, 1416 may be out of a range of the hinge groove 1414. The dimple portion 1415, 1416 at a portion outside the hinge groove 1414 is out of a range of the vanes 145, and thus, the dimple portion 1415, 1416 acts as a type of refrigerant passage between the compression chambers. Then, refrigerant in the space constituting the discharge chamber (V2) leaks into a space constituting the suction chamber (V1), thereby causing compression loss. Accordingly, the radial width (D1) of the dimple portion 1415, 1416 may be defined within the radial depth (D2) of the hinge groove 1414.

However, in order to hold oil or refrigerant in the dimple portion 1415, 1416, it may be spaced apart by an appropriate sealing distance between the dimple portion 1415, 1416 and the hinge groove 1414. In addition, the dimple portion 1415, 1416 may be spaced apart from inner and outer peripheral surfaces of the roller by an appropriate sealing distance.

Referring back to FIG. 6, the dimple portion 1415, 1416 may have an inner sealing surface 1412*a*, 1413*a* between an inside of the dimple portion 1415, 1416 and the inner circumferential surface 1411*a* of the roller body 1411 and an outer sealing surface 1412*b*, 1413*b* between an outer side of the dimple portion 1415, 1416 and the outer circumferential surface 1411*b* of the roller body 1411. The inner sealing surface 1412*a*, 1413*a* and the outer sealing surface 1412*b*, 1413*b* may be higher than an axial side surface of the dimple portion 1415, 1416. Accordingly, an inner space of the dimple portion 1415, 1416 may be separated from the hinge groove 1414 as well as the inner circumferential surface 1411*a* and the outer circumferential surface 1411*b* of the roller body 1411 to seal a space on all surfaces except an axial side surface thereof, and the space may be filled with oil or refrigerant.

Figure 8:
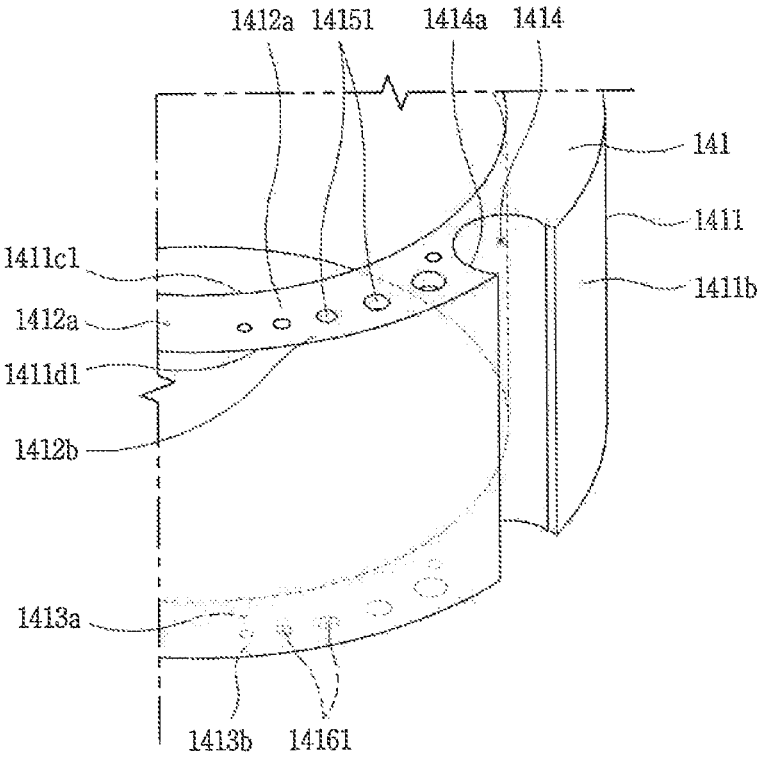
FIGS. 8 and 9 are enlarged views to explain a shape of the dimple portion according to an embodiment.
Figure 9:
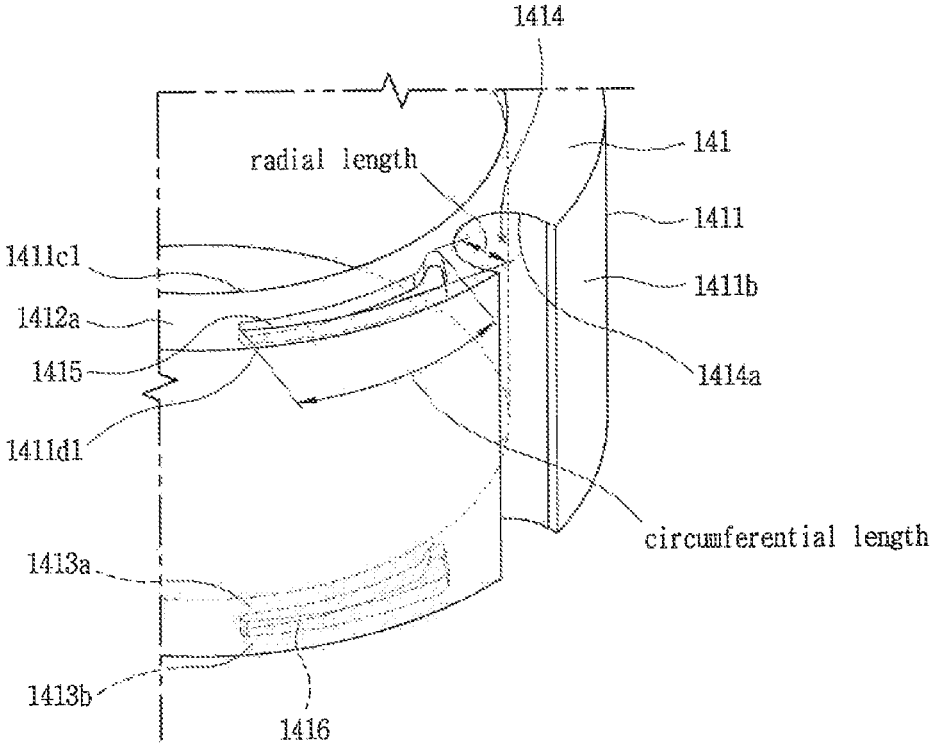

Volumes of the dimple portions 1415, 1416 may be defined differently or identically along the circumferential direction. FIGS. 8 and 9 are enlarged views shown to explain a shape of the dimple portion according to an embodiment.

Referring to FIG. 8, the first dimple portion 1415 may include a plurality of dimples 14151 provided on the first sealing surface 1412 of the roller 141, and the second dimple portion 1216 may include a plurality of dimples 14161. The dimples 14151, 14161 may have a same volume within a preset or predetermined circumferential range, but the dimples 14151, 14161 may also increase an entire volume of the dimples 14151, 14161 toward the hinge groove 1414 as in the embodiment illustrated in FIG. 8. Hereinafter, for convenience of description, the first dimple portion will be mainly described, but the second dimple portion may be the same as the first dimple portion.

This, as described above, not only causes the greatest amount of thermal deformation around a discharge side of the hinge groove 1414, but also allows a portion disposed with the hinge groove 1414 to be tilted the most by the vane 145. Therefore, it is advantageous that an entire volume of the dimples 14151 increases toward the hinge groove 1414, thereby supplying a relatively large amount of oil or refrigerant around the hinge groove 1414. A width or depth of the dimples 14151 formed around the hinge groove 1414 may be larger than a width or depth of the dimples 14151 away from the hinge grooves 1414.

Referring to FIG. 9, the first dimple portion 1415 may include one dimple. Even in this case, the dimple may be deeper or wider toward the hinge groove 1414 to have a larger volume adjacent the hinge groove 1414.

Another embodiment of a dimple portion in the rotary compressor according to an embodiment will be described hereinafter. In other words, in the previous embodiment, the dimple portion is disposed only at one circumferential side around the hinge groove, but in this embodiment, dimple portions are disposed at both circumferential sides around the hinge groove.

Figure 10:
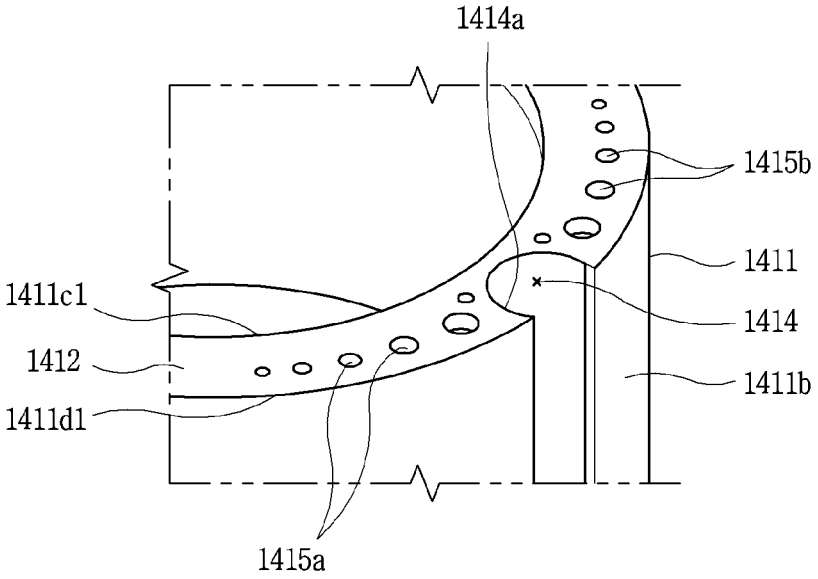
FIGS. 10 through 12 are perspective views of a dimple portion of a vane roller according to still another embodiment.
Figure 11:
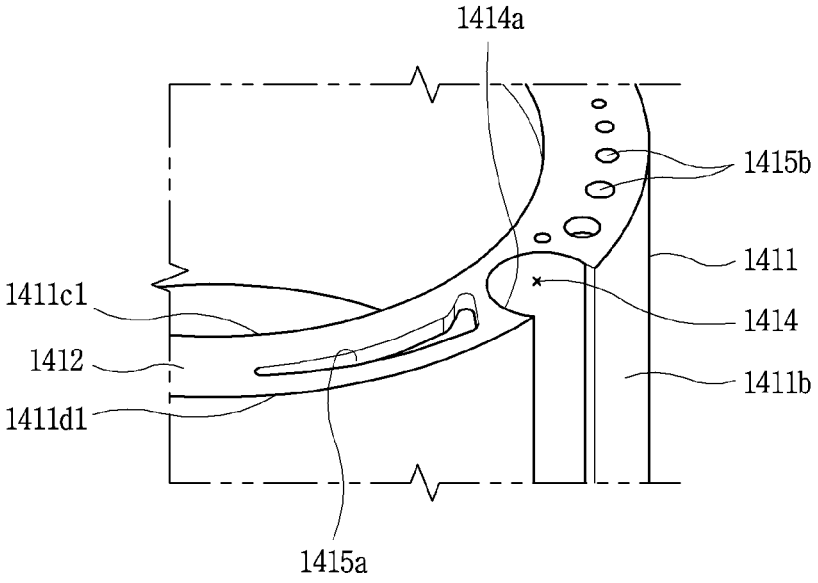
Figure 12:
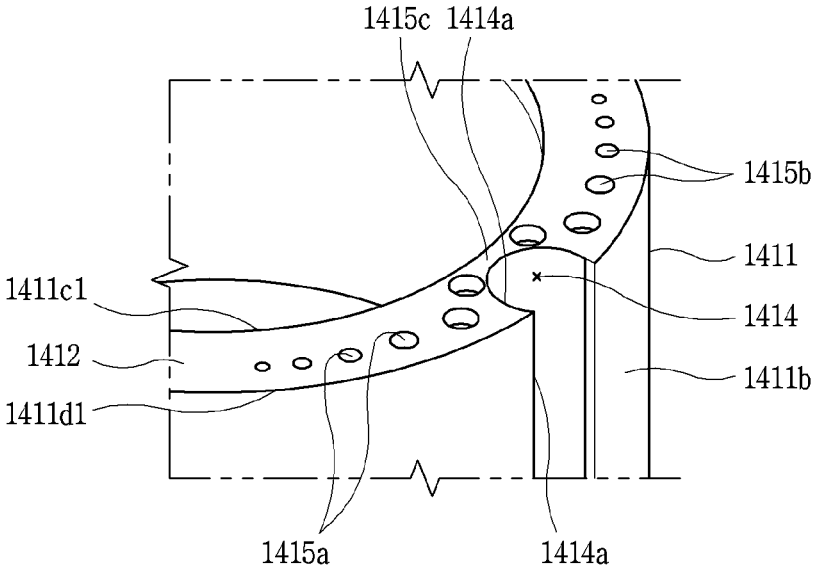

FIGS. 10 through 12 are perspective views of a dimple portion of a vane roller according to still another embodiment. Even in these drawings, the first dimple portion will be mainly described, but the second dimple portion may be the same.

Referring to FIGS. 10 and 11, the first dimple portion 1415 according to the embodiment may be disposed over first portion (S1) on a suction side and second portion (S2) on a discharge side of the roller body 1411. For the dimple portion 1415, a dimple portion disposed at the first portion (S1) with respect to first imaginary line (L1) may be defined as a suction-side dimple portion 1415*a*, and a dimple portion disposed at the second portion (S2) with respect to the first imaginary line (L1) may be defined as a discharge-side dimple portion 1415*b*.

The suction-side dimple portion 1415*a* and the discharge-side dimple portion 1415*b* may have a same shape or different shapes. FIG. 10 is a view illustrating a case where the suction-side dimple portion 1415*a* and the discharge-side dimple portion 1415*b* are symmetrical.

In a case where the suction-side dimple portion 1415*a* and the discharge-side dimple portion 1415*b* are defined in the same shape, both the dimple portions 1415*a*, 1415*b* may be formed in a single process, thereby facilitating processing. However, as described above, as the roller body 1411 has a larger amount of thermal deformation at the second portion (S2) compared to the first portion (S1), the amount of wear at the second portion (S2) may be greater than that at the first portion (S1) even when the first portion (S1) and the second portion (S2) of the roller body 1411 are tilted at a substantially same angle around the hinge groove 1414, In consideration of this, as shown in FIG. 11, the suction-side dimple portion 1415*a* and the discharge-side dimple portion 1415*b* may be defined in different shapes. For example, the suction-side dimple portion 1415*a* may include a plurality of dimples 14151, while the discharge-side dimple portion 1415*b* may include a single dimple. As described above, in a case of having a same range and the same axial depth, a dimple portion with a single dimple may secure a larger thermal deformation margin and a larger overall volume than a dimple portion with a plurality of dimples. Therefore, it may be advantageous that the discharge-side dimple portion 1415*b* provided at the second portion (S2) having a relatively large thermal deformation amount is a single dimple.

In addition, as shown in FIG. 12, a partition wall portion or partition wall 1415*c* may be disposed between the suction-side dimple portion 1415*a* and the discharge-side dimple portion 1415*b*. The partition wall portion 1415*c* may be defined by the suction-side dimple portion 1415*a* and the discharge-side dimple portion 1415*b* spaced apart from each other with the hinge groove 1414 interposed therebetween. In this case, the suction-side dimple portion 1415*a* and the discharge-side dimple portion 1415*b* may be defined in the same shape or may be defined in different shapes.

When the suction-side dimple portion 1415*a* and the discharge-side dimple portion 1415*b* are identical to each other, both the dimple portions 1415*a*, 1415*b* may be easily formed, and when the suction-side dimple portion 1415*a* and the discharge-side dimple portion 1415*b* have different shapes, the dimple portions may be appropriately selected according to conditions.

Other embodiments of a dimple portion will be described hereinafter. In other words, in the previous embodiments, the first dimple portion provided on the first sealing surface and the second dimple portion provided on the second sealing surface may be symmetric with each other in shape and size, but the first dimple portion and the second dimple portion may be asymmetric in shape and size. In this embodiment, the first dimple portion and the second dimple portion may be defined differently according to respective conditions.

Figure 13:
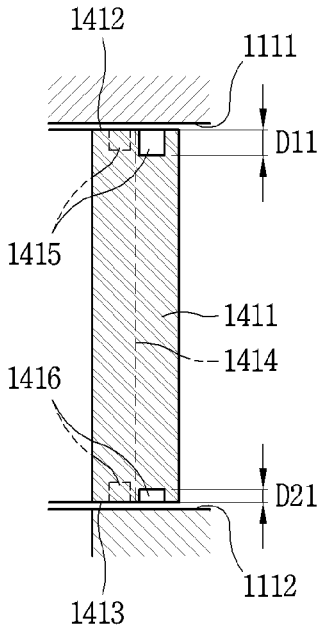
FIGS. 13 and 14 are schematic views showing of a first dimple portion and a second dimple portion of the vane roller according to an embodiment.
Figure 14:
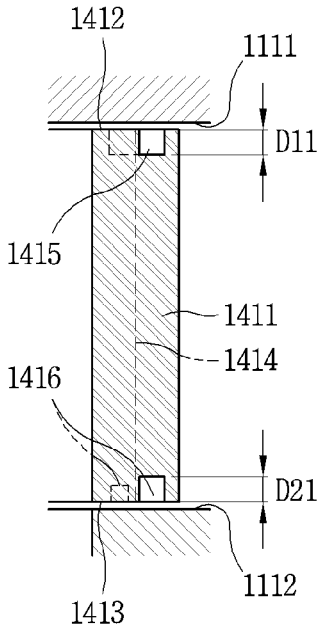

FIGS. 13 and 14 are schematic views of a first dimple portion and a second dimple portion of a vane roller according to still another embodiment.

Referring to FIG. 13, the first dimple portion 1415 and the second dimple portion 1416 may be respectively include a plurality of dimples. In this case, an axial depth (D11) of each of the dimples constituting the first dimple portion 1415 may be deeper than an axial depth (D21) of each of the dimples constituting the second dimple portion 1416.

Although not shown in the drawings, a radial width of each of the dimples of the first dimple portion may be greater than a radial width of each of the dimples of the second dimple portion. In addition, the dimples constituting the first dimple portion may have different depths, and the dimples constituting the second dimple portion may be formed to have different depths. In this case, a total depth of dimples constituting the first dimple portion may be deeper than that of the dimples constituting the second dimple portion.

Referring to FIG. 14, the first dimple portion 1415 and the second dimple portion 1416 may have different shapes. For example, the first dimple portion 1415 may include a single dimple, and the second dimple portion 1416 may include a plurality of dimples. In this case, a width or depth of dimples constituting the first dimple portion may be greater or deeper than a width or depth of dimples constituting the second dimple portion.

A basic construction of the first dimple portion 1415 and the second dimple portion 1416 and effects thereof may be substantially the same as those of the previous embodiments. Therefore, repetitive description thereof has been omitted.

However, in a case of defining axial depths of the first dimple portion 1415 and the second dimple portion 1416 to be different, as in the previous embodiment, though the thermal deformation amounts of the first sealing surface 1412 of the roller 141 and the second sealing surface 1413 in the roller 141 are different from each other, a gap on the first sealing surface 1412 and a gap on the second sealing surface 1413 with respect to each plate 110, 120 may be maintained approximately constant. In other words, as the discharge port 114 is disposed adjacent the first dimple portion 1415, the roller 141 adjacent to the discharge port 114 has a thermal deformation amount on the first sealing surface 1412 greater than that on the second sealing surface 1413 located away from the discharge portion 114. However, as an axial depth of the first dimple portion 1415 may be larger than that of the second dimple portion 1416 as in the embodiments or the first dimple portion 1415 is include a single dimple and the second dimple portion 1416 include a plurality of dimples, a volume of the first dimple portion 1415 may be greater than a volume of the second dimple portion 1416, thereby compensating a degree of pressing or an amount of wear due to a difference in thermal deformation. Then, a gap on the first sealing surface 1412 and a gap on the second sealing surface 1413 with respect to each of the plates 110, 120 may be maintained substantially constant.

A rotary compressor according to another embodiment will be described hereinafter.

In other words, in the previous embodiment, the dimple portion is disposed on the first sealing surface and the second sealing surface of the roller, respectively, but in this embodiment, the dimple portion is disposed on an axial side surface of the main plate and/or an axial side surface of the sub plate facing the first sealing surface and the second sealing surface of the roller.

Figure 15:
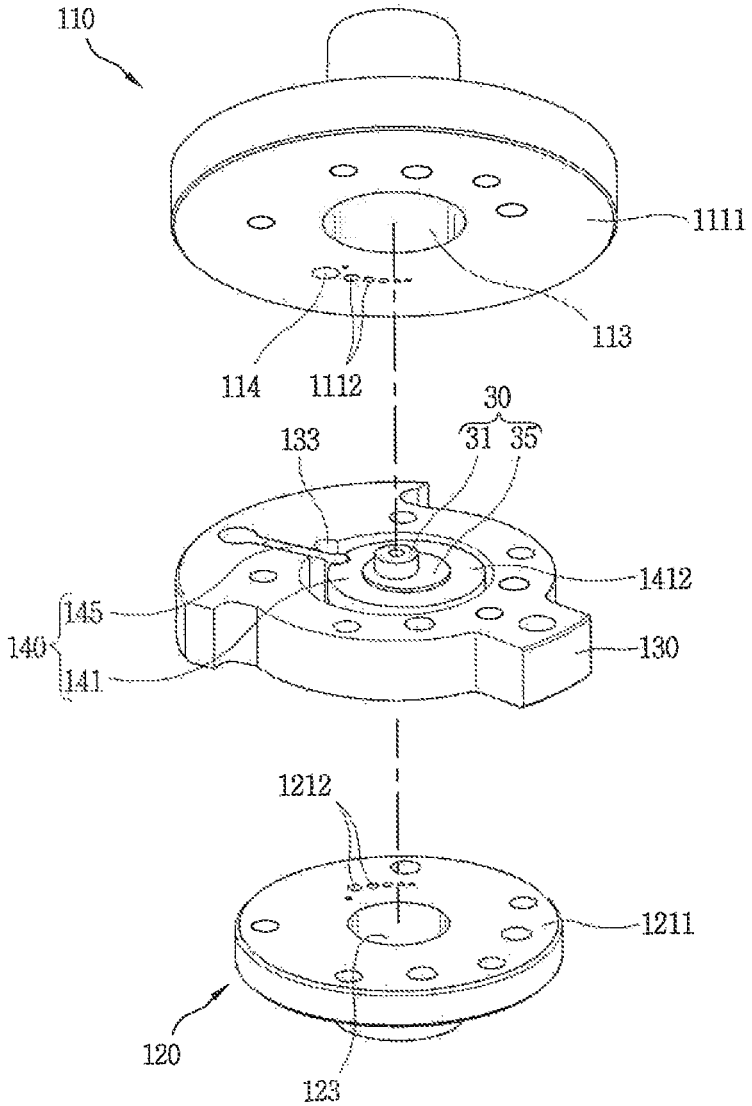
FIG. 15 is an exploded perspective view of a compression unit in a rotary compressor according to an embodiment.
Figure 16:
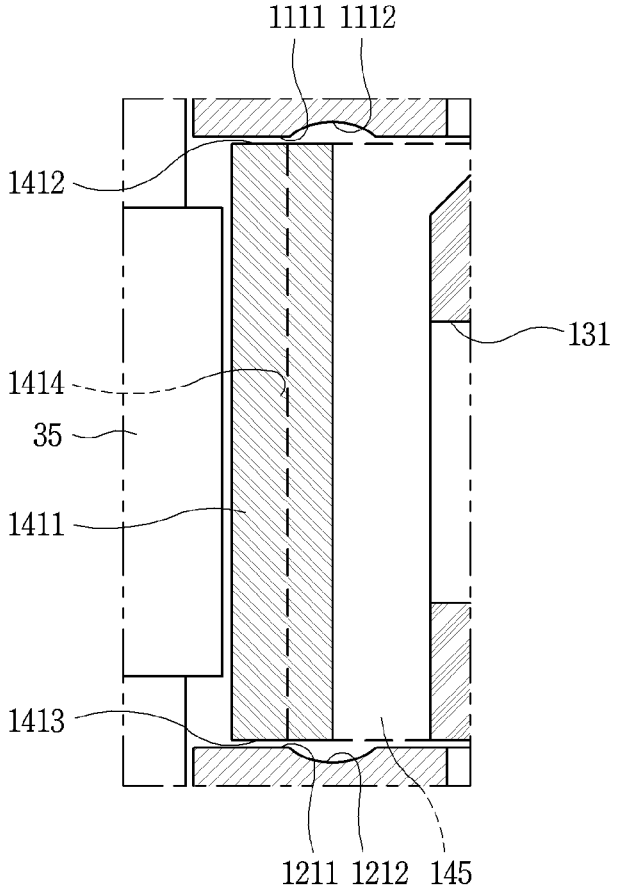
FIG. 16 is a cross-sectional view showing a portion of the roller by assembling the compression unit of FIG. 15.

FIG. 15 is an exploded perspective view of a compression unit in a rotary compressor according to another embodiment. FIG. 16 is a cross-sectional view showing a portion of the roller by assembling the compression unit of FIG. 15.

Referring to FIGS. 15 and 16, a first dimple portion 1112 is disposed on the first thrust surface 1111 of the main plate 110, and a second dimple portion 1212 is disposed on a second thrust surface 1211 of the sub plate 120. A structure and effects thereof for the dimple portion according to this embodiment are substantially the same as those of the dimple portion described in the previous embodiments. Therefore, detailed description thereof has been omitted. However, as the first dimple portion 1112 in the dimple portions according to this embodiment is disposed on the first thrust surface provided with the discharge port, a relationship between the first dimple portion 1111 and the discharge port 114 will be described hereinafter.

For example, the first dimple portion 1112 according to this embodiment may be disposed at a position where the roller 141 passes while performing an orbiting movement in consideration of a trajectory of the roller 141. In this case, the first dimple portion 1112 may completely surround a circumference of the discharge port 114 or surround at least a portion thereof.

In addition, the first dimple portion 1112 according to this embodiment may communicate with the discharge port 114. Accordingly, even though the roller 141 is tilted so that the first sealing surface 1412 of the roller 141 is close to the first thrust surface 1111 of the main plate 110, the first sealing surface 1412 of the roller 141 may be prevented from pressing against the first thrust surface 1111 of the main plate 110. In addition, the dimple portion 1112 according to this embodiment may serve as a type of discharge guide groove as it communicates with the discharge port 114 to reduce discharge loss.

However, when a lateral cross-sectional area of the first dimple portion 1112 is wide, for example, when a cross-sectional area of the discharge port is wider, the discharge port 114 and the first dimple portion 1112 may be separated from each other. If the lateral cross-sectional area of the first dimple portion 1112 is wide, refrigerant that has not reached discharge pressure may leak to the discharge port 114 through the first dimple portion 1112. Accordingly, when a lateral cross-sectional area of the first dimple portion 1112 is wide, the discharge port 114 and the first dimple portion 1112 may be separated from each other.

On the other hand, although not shown in the drawings, the dimple portions according to embodiments may be disposed on a sealing surface of the roller and a thrust surface facing the sealing surface, respectively. The basic configuration thereof is similar to the previous embodiments, and thus, repetitive description thereof has been omitted.

In this way, even when the roller is tilted during operation of the compressor in a hinge vane type, lubricity between the roller and the plate may be enhanced to suppress a contact surface of the roller or the plate from being excessively in close contact with the roller. With this structure, friction loss between the roller and the plate may be reduced to enhance performance of the compressor, and wear of the roller or plate may be suppressed to improve reliability.

In addition, a recessed dimple portion or lubrication portion may be defined on an axial end surface of the roller or an axial side surface of the plate facing the same in a hinge vane type, but a size and position of the dimple portion or lubrication portion may be adjusted to suppress compression efficiency from being lowered by the dimple portion or lubrication portion.

In described embodiments, a case where upper and lower edges of the roller are perpendicular has been described with reference to an example, but the foregoing dimple portion or lubrication portion may also be disposed even when the upper and lower edges of the roller are defined with annular inclined or annular curved surfaces along a circumferential direction. In other words, the sealing surface of the roller according to embodiments is an axial cross section perpendicular to an inner or outer circumferential surface of the roller, and the dimple portion or lubrication portion may be disposed on the sealing surface of the roller. Therefore, when an annular inclined surface or an annular curved surface is defined at an upper or lower edge of the roller, the annular inclined surface or the annular curved surface does not correspond strictly to the sealing surface of the roller. Accordingly, when the annular inclined surface or the annular curved surface is defined at an upper edge or lower edge of the roller, the dimple portion or lubrication portion may be disposed at a position that does not radially overlap with the annular inclined surface or the annular curved surface.

Further, the described embodiments have been mainly described with reference to an example in which the roller and the vane are rotatably coupled to each other, but the dimple portion or lubrication portion may also be similarly applicable to a case where the roller and the vane are formed as a single body. In addition, the described embodiments have been mainly described with reference to an example applied to a vane roller type in which the roller and the vane are hinge-coupled to each other, but may also be applicable to a case where the roller and the vane are integrated into a single body or a rolling piston type in which the vane is slidably in contact with an outer circumferential surface of the roller. However, in a rolling piston type, as the rolling piston is not constrained by the vanes, the dimple portion or lubrication portion may be respectively disposed at an axial side surface of the main bearing or the sub bearing facing both axial ends of the rolling piston.

The dimple portion described may be equally applicable to a case where the roller and the vane are formed as a single body. In addition, embodiments have been mainly described with reference to an example of one cylinder, but the dimple portion or lubrication portion may also be similarly applicable to a case of having a plurality of cylinders.

With a rotary compressor according to embodiments, dimple portions or lubrication portions that are axially recessed may be defined on both axial end surfaces of the roller or on axial side surfaces of the main plate and the sub plate facing the same in a hinge vane type. With this structure, it may be possible to prevent the roller from colliding with or pressing against the plate by tilting or thermal expansion of the roller generated during operation of the compressor. With this structure, a contact surface between the roller and the plate may be suppressed from being in close contact with each other to suppress the roller or the plate from being damaged or performance of the compressor due to friction loss from being deteriorated, thereby improving reliability and performance of the compressor.

Further, according to embodiments disclosed herein, the dimple portions or the lubrication portions may be defined on axial end surfaces of the roller or axial side surfaces of the plate facing the same in a hinge vane type, but the dimple portions or lubrication portions may be defined at both sides, respectively, with a hinge groove interposed therebetween. With this structure, compression or wear around the hinge groove that may be generated by the roller constrained to the vane may be suppressed in a hinge vane type, thereby further enhancing reliability and performance of the compressor.

Furthermore, according to embodiments disclosed herein, the dimple portions or the lubrication portions may be defined on axial end surfaces of the roller or axial side surfaces of the plate facing the same in a hinge vane type but a size and position of the dimple portions or lubrication portions may be defined in consideration of a compression reaction force and thermal expansion amount thereof. With this structure, the possibility of contact at a portion where a tilting amount or a thermal deformation amount is relatively high may be reduced, thereby further enhancing reliability and performance of the compressor.

On the other hand, according to embodiments disclosed herein, as a tilting phenomenon of the roller may be further generated when using a high-pressure refrigerant, such as R32, the dimple portions or the lubrication portions according to embodiments may be usefully applied to a hinge vane type rotary compressor to which such a high-pressure refrigerant is applied.

Embodiments disclosed herein provide a rotary compressor capable of suppressing a roller from colliding with or pressing against plates located at both axial sides of the roller in a hinge vane type. Further, embodiments disclosed herein provide a rotary compressor capable of defining a dimple portion or a lubrication portion on an axial end surface of a roller or an axial side surface of a plate facing the same in the hinge vane type, thereby allowing the roller to avoid colliding with or pressing against the plate even when the roller is tilted in an axial direction.

In addition, embodiments disclosed herein provide a rotary compressor capable of defining a dimple portion or a lubrication portion in consideration of thermal deformation of a roller or a plate located at both axial ends of the roller, thereby allowing the roller to effectively avoid excessively colliding with or pressing against the plate. As a suction chamber and a discharge chamber are defined around the vane, embodiments disclosed herein provide a rotary compressor capable of defining a dimple portion or a lubrication portion, thereby preventing refrigerant compressed by the dimple portion or the lubrication portion from leaking in advance.

Embodiments disclosed herein provide a rotary compressor in which the vane is hinge-coupled to the roller, and a dimple portion or a lubrication portion that is axially recessed is defined at an outer edge of the roller. An outer circumferential surface of the roller may be defined with a hinge groove to which the vane is hinge-coupled, and the dimple portion or the lubrication portion may be defined to communicate with the hinge groove.

The dimple portion or the lubrication portion may be defined at a discharge side with respect to the hinge groove. The dimple portions or the lubrication portions may be disposed at a discharge side and a suction side, respectively, around the hinge groove.

Further, embodiments disclosed herein provide a rotary compressor, wherein an annular-shaped member and a plate-shaped member are hinge-coupled to an inside of a cylinder, and the annular-shaped member is rotatably coupled to an eccentric portion of a rotary shaft, and the plate-shaped member is slidably coupled to the cylinder, and a space defining a suction pressure is formed at one circumferential side, and a space defining a discharge pressure is formed at the other circumferential side around the plate-shaped member, and dimple portion or lubrication portions are defined in an axial direction at both axial end surfaces of the annular-shaped member belonging to the space defining the discharge pressure. A plurality of plates forming the space defining the suction pressure and the space defining discharge pressure together with the cylinder may be provided at both axial sides of the annular-shaped member, and one of the plurality of plates may be provided with a discharge port, and the respective dimple portions or lubrication portions may have the same or different depths.

In addition, embodiments disclosed herein provide a rotary compressor in which the roller and the vane are coupled to each other, wherein a hinge groove is disposed to extend along an axial direction to be rotatably coupled to the vane on an outer circumferential surface of the roller, and an inner circumferential surface of the dimple portion or lubrication portion is smaller than or equal to a radial depth of the hinge groove.

Moreover, embodiments disclosed herein provide a rotary compressor that may include a drive motor; a rotary shaft that transmits a rotational force of the drive motor and has an eccentric portion; a cylinder provided at one side of the drive motor; a plurality of plates provided at both axial sides of the cylinder to define a compression space together with the cylinder; a roller coupled to an eccentric portion of the rotary shaft and defined with a hinge groove on an outer circumferential surface thereof; and a vane provided with a hinge protrusion rotatably coupled to a hinge groove of the roller by a predetermined angle to be movably coupled to the cylinder. Dimple portions or lubrication portions may be disposed at both axial ends of the roller or axial side surfaces of the plate facing the roller.

Embodiments disclosed herein provide a rotary compressor that may include a rotary shaft; a plurality of plates that supports the rotary shaft; a cylinder provided between the plurality of plates to define a compression space, and provided with a vane slot; a roller slidably coupled to the rotary shaft to be provided inside of the cylinder, and disposed with a hinge groove on an outer circumferential surface thereof; and a vane, one or a first end of which is slidably coupled to the vane slot of the cylinder, and the other or a second end of which is rotatably coupled to the hinge groove of the roller. At least one of both axial end surfaces of the roller facing the plurality of plates may be provided with a dimple portion having a preset or predetermined depth.

The dimple portion may be deeper than an edge between an axial end surface and an inner circumferential surface of the roller or an edge between an axial end surface and an outer circumferential surface of the roller. Further, an inner sealing surface may be disposed between the dimple portion and an inner circumferential surface of the roller, and an outer sealing surface may be disposed between the dimple portion and an outer circumferential surface of the roller, and the inner sealing surface and the outer sealing surface may be higher than an axial side surface of the dimple portion.

The dimple portion may be disposed to separate between an axial end surface of the roller and an inner circumferential surface of the hinge groove. The dimple portion may be disposed to connect an axial end surface of the roller and an inner circumferential surface of the hinge groove. Further, a radial depth of the dimple portion may be smaller than or equal to that of the hinge groove.

The dimple portion may be disposed with a plurality of dimples. At least two or more dimples of the plurality of dimples may have different volumes. Further, a dimple adjacent to the hinge groove among the plurality of dimples may have a larger volume than a dimple located away from the hinge groove.

The dimple portion may be disposed in an elongated manner in a circumferential direction. The dimple portion may have a different cross-sectional area along the circumferential direction. Further, the dimple may have a cross-sectional area at a side adjacent to the hinge groove than that at a side away from the hinge groove.

When divided into four quadrants by a first imaginary line passing through a center of the roller and a center of the hinge groove and a second imaginary line passing through the center of the roller and orthogonal to the first imaginary line, the dimple portion may be disposed within a range of a quadrant adjacent to the hinge groove. When a portion of the roller that belongs to one quadrant adjacent to the hinge groove with respect to the hinge groove is referred to as a first portion, and a portion of the roller that belongs to another quadrant adjacent thereto is referred to as a second portion, and the second portion in the compression space defines a space having a higher pressure than the first portion, the dimple portion may be disposed within a range of the second portion.

Embodiments disclosed herein provide a rotary compressor that may include a rotary shaft; a plurality of plates that supports the rotary shaft; a cylinder provided between the plurality of plates to define a compression space, and provided with a vane slot; a roller coupled to the rotary shaft, both axial end surfaces of which respectively define sealing surfaces slidably brought into contact with thrust surfaces of the plates; a vane, one or a first end of which is slidably coupled to the vane slot of the cylinder, and the other or a second end of which is coupled to the roller, and one or a first circumferential side of which defines a space constituting a suction pressure, and the other or a second circumferential side of which defines a space constituting a discharge pressure; and a lubrication portion disposed on at least one of both sealing surfaces of the roller or disposed on a thrust surface of at least one of the plurality of plates. At least part or a portion of the lubrication portion may be disposed to include the space constituting the discharge pressure.

A discharge port may be disposed on any one of the plurality of plates, and the lubrication portions may be disposed on both sealing surfaces of the roller, respectively, and an axial depth of a first lubrication portion, between the lubrication portions, disposed on a first sealing surface at a side facing a plate disposed with the discharge port may be greater than or equal to that of a second lubrication portion disposed on a second sealing surface at an opposite side thereof. A discharge port may be disposed on any one of the plurality of plates, and the lubrication portion may be disposed on a plate disposed with the discharge port, and the lubrication portion may be disposed to communicate with the discharge port.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a rotary shaft;

a plurality of plates that supports the rotary shaft;

a cylinder provided between the plurality of plates to define a compression space, and provided with a vane slot;

a roller slidably coupled to the rotary shaft inside of the cylinder, and having a hinge groove on an outer circumferential surface thereof; and a vane, a first end of which is slidably coupled to the vane slot of the cylinder, and a second end of which is rotatably coupled to the hinge groove of the roller, wherein at least one of first and second axial end surfaces of the roller facing the plurality of plates is provided with a dimple portion having a predetermined depth, and wherein the dimple portion is separated from an inner circumferential surface of the hinge groove in a circumferential direction of the hinge groove so as not to communicate with the hinge groove.

2. The rotary compressor of claim 1, wherein the dimple portion is disposed at an edge between the respective axial end surface and an inner circumferential surface of the roller or an edge between the respective axial end surface and an outer circumferential surface of the roller.

3. The rotary compressor of claim 2, wherein an inner sealing surface is disposed between the dimple portion and the inner circumferential surface of the roller, and an outer sealing surface is disposed between the dimple portion and the outer circumferential surface of the roller, and wherein the inner sealing surface and the outer sealing surface are higher than an axial side surface of the dimple portion.

4. The rotary compressor of claim 1, wherein the dimple portion includes a plurality of dimples.

5. The rotary compressor of claim 4, wherein at least two or more dimples of the plurality of dimples have different volumes, and wherein a dimple adjacent to the hinge groove among the plurality of dimples has a larger volume than a dimple located away from the hinge groove.

6. The rotary compressor of claim 1, wherein the dimple portion has a circumferential length greater than a radial length thereof.

7. The rotary compressor of claim 6, wherein the dimple portion has a cross-sectional area at a side adjacent to the hinge groove larger than a cross-sectional area at a side away from the hinge groove.

8. The rotary compressor of claim 1, wherein when divided into four quadrants by a first imaginary line passing through a center of the roller and a center of the hinge groove and a second imaginary line passing through the center of the roller and orthogonal to the first imaginary line, the dimple portion is within a range of a quadrant adjacent to the hinge groove.

9. The rotary compressor of claim 8, wherein when a portion of the roller that belongs to one quadrant adjacent to the hinge groove with respect to the hinge groove is referred to as a first portion, and a portion of the roller that belongs to another quadrant adjacent thereto is referred to as a second portion, and the second portion in the compression space defines a space having a higher pressure than the first portion, and the dimple portion is within a range of the second portion.

10. A rotary compressor, comprising:

a rotary shaft;

a plurality of plates that supports the rotary shaft;

a cylinder provided between the plurality of plates to define a compression space, and provided with a vane slot;

a roller coupled to the rotary shaft, axial end surfaces of which respectively define sealing surfaces slidably brought into contact with thrust surfaces of the plurality of plates;

a vane, a first end of which is slidably coupled to the vane slot of the cylinder, and a second end of which is coupled to the roller, and a first circumferential side of which defines a space having a suction pressure, and a second circumferential side of which defines a space a discharge pressure; and a lubrication portion disposed on at least one of the sealing surfaces of the roller or on the thrust surface of at least one of the plurality of plates, wherein at least a portion of the lubrication portion includes the space having the discharge pressure, wherein a discharge port is disposed on any one of the plurality of plates, and wherein the lubricating portion has a volume or cross-sectional area adjacent to the discharge port greater than a volume or cross-sectional area away from the discharge port.

11. The rotary compressor of claim 10, wherein the lubrication portion is disposed on both of the sealing surfaces of the roller, respectively, and wherein an axial depth of a first lubrication portion, of the lubrication portion, disposed on a first sealing surface at a side facing a plate having the discharge port is defined to be greater than or equal to an axial depth of a second lubrication portion, of the lubrication portion, disposed on a second sealing surface at an opposite side thereof.

12. The rotary compressor of claim 10, wherein the lubrication portion is disposed on a plate having the discharge port, and wherein the lubrication portion communicates with the discharge port.

13. A rotary compressor, comprising:

a rotary shaft;

a plurality of plates that supports the rotary shaft;

a cylinder provided between the plurality of plates to define a compression space, and provided with a vane slot;

a roller slidably coupled to the rotary shaft inside of the cylinder, and having with a hinge groove on an outer circumferential surface thereof; and a vane slidably coupled to the vane slot of the cylinder and to the hinge groove of the roller, wherein at least one of axial end surfaces of the roller facing the plurality of plates includes at least one dimple or groove recessed in the respective axial end surface to a predetermined depth, wherein the at least one dimple or groove is separated from an inner circumferential surface of the hinge groove in a circumferential direction of the hinge groove so as not to communicate with the hinge groove.

14. The rotary compressor of claim 13, wherein the dimple or groove comprises a plurality of dimples extending in a circumferential direction.

15. The rotary compressor of claim 14, wherein the plurality of dimples have different sizes or volumes.

16. The rotary compressor of claim 15, wherein dimples of the plurality of dimples positioned closer to the hinge groove have a larger size or volume than dimples of the plurality of dimples positioned farther away from the hinge groove.

17. The rotary compressor of claim 13, wherein the at least one dimple or groove includes a plurality of dimples or grooves positioned on both sides of the hinge groove and extending in a circumferential direction.

* * * * *